US011565363B2

(12) United States Patent
Vianello et al.

(10) Patent No.: US 11,565,363 B2
(45) Date of Patent: Jan. 31, 2023

(54) AUTOMATIC MACHINE AND AUTOMATIC METHOD FOR GRINDING THE EDGES OF GLASS SHEETS

(71) Applicant: FOREL SPA, Frazione Vallio (IT)

(72) Inventors: Fortunato Vianello, Frazione Vallio (IT); Riccardo Vianello, Frazione Vallio (IT)

(73) Assignee: FOREL SPA, Frazione Vallio (IT)

( * ) Notice: Subject to any disclaimer, the term of this patent is extended or adjusted under 35 U.S.C. 154(b) by 826 days.

(21) Appl. No.: 16/341,715

(22) PCT Filed: Oct. 12, 2017

(86) PCT No.: PCT/EP2017/076126
§ 371 (c)(1),
(2) Date: Apr. 12, 2019

(87) PCT Pub. No.: WO2018/069472
PCT Pub. Date: Apr. 19, 2018

(65) Prior Publication Data

US 2020/0047304 A1 Feb. 13, 2020

(30) Foreign Application Priority Data

Oct. 14, 2016 (IT) ..... 102016000103219

(51) Int. Cl.
*B24B 9/10* (2006.01)
*B24B 27/00* (2006.01)
*B24B 41/00* (2006.01)

(52) U.S. Cl.
CPC ..... *B24B 9/102* (2013.01); *B24B 27/0023* (2013.01); *B24B 27/0069* (2013.01); *B24B 27/0076* (2013.01); *B24B 41/005* (2013.01)

(58) Field of Classification Search
CPC . B24B 9/102; B24B 27/0023; B24B 27/0069; B24B 27/0076; B24B 41/005;
(Continued)

(56) References Cited

U.S. PATENT DOCUMENTS 4,716,686 A * 1/1988 Lisec ..... B24B 9/102 198/339.1
6,910,953 B2 * 6/2005 Allaire ..... B24B 21/00 451/296

(Continued)

FOREIGN PATENT DOCUMENTS

DE 4419963 C1 9/1995
EP 0165232 A2 12/1985

(Continued)

OTHER PUBLICATIONS

International Search Report dated Nov. 15, 2017 re: Application No. PCT/EP2017/076126, pp. 1-3, citing: EP 2 039 464 A1, EP 1 769 885 A1, EP 2 862 672 A1 and WO 2016/055966 A1.

(Continued)

*Primary Examiner* — Joel D Crandall
*Assistant Examiner* — Jason Khalil Hawkins
(74) *Attorney, Agent, or Firm* — Cantor Colburn LLP

(57) ABSTRACT

An automatic machine and an automatic method for grinding the edges of glass sheets are disclosed. The machine is provided with a machine body with motorized support and conveyance rollers or belts, an input conveyor with motorized support and conveyance rollers or belts, an output conveyor with motorized support and conveyance rollers and belts. There are at least two elements for conveying the glass sheets, a lower one and an upper one, which actuate respectively the synchronous motions about a lower axis and an upper axis, which engage and convey the glass sheets, which are interfaced alternately, for example the odd sheets (Continued)

with the lower conveyance elements and the even sheets with the upper conveyance.

9 Claims, 12 Drawing Sheets

(58) Field of Classification Search
CPC .. B24B 9/005; B24B 9/08; B24B 9/10; B24B 41/002; B24B 41/02; B65G 49/06; B65G 49/061; B25B 11/005
USPC .... 451/44, 41, 179, 182, 192, 195, 336, 388
See application file for complete search history.

(56) References Cited

U.S. PATENT DOCUMENTS 7,771,248 B2 * 8/2010 Vianello ..... B24B 9/102 451/41
8,282,433 B2 * 10/2012 Lavagna ..... E21B 17/012 441/4
2007/0075474 A1 * 4/2007 Vianello ..... B24B 49/02 269/55
2008/0092594 A1 * 4/2008 Vianello ..... B24B 9/102 65/61
2009/0081930 A1 * 3/2009 Vianello ..... B24B 47/22 451/388

FOREIGN PATENT DOCUMENTS

| | | | |
|---|---|---|---|
| EP | 0920954 | A2 | 6/1999 |
| EP | 1769885 | A1 | 4/2007 |
| EP | 2039464 | A1 | 3/2009 |
| EP | 2719501 | A1 | 4/2014 |
| EP | 2862672 | A1 | 4/2015 |
| WO | 2016055966 | A1 | 4/2016 |

OTHER PUBLICATIONS

IT Search Report dated Jul. 7, 2017 re: Application No. IT 2016000103219, pp. 1-8, citing: EP 2 039 464 A1, EP 1 769 885 A1, EP 2 862 672 A1 and WO 2016/055966 A1.
Written Opinion dated Nov. 15, 2017 re: Application No. PCT/EP2017/076126, pp. 1-6, citing: EP 2 039 464 A1, EP 1 769 885 A1, EP 2 862 672 A1 and WO 2016/055966 A1.

* cited by examiner

AUTOMATIC MACHINE AND AUTOMATIC METHOD FOR GRINDING THE EDGES OF GLASS SHEETS

TECHNICAL FIELD

The disclosure relates to an automatic machine for grinding the edges of a perimeter of rectangular or non-rectangular contoured glass sheets and an automatic method for grinding the edges of glass sheets.

BACKGROUND

Methods for grinding (or, in the jargon, "arrissing") the edges of glass sheets in the condition in which they are after cutting performed on sheets in the source format in order to obtain sheets in the destination format, i.e., having the final shape and dimension for use, are currently known.

In principle, the grinding operation is applicable to any step of the working of the glass sheet, for example before the manufacture of the insulating glazing unit (or in the jargon "double glazing unit") or before the tempering of each of the individual glass sheet.

Grinding is performed for two reasons: the first relates to safety in handling said sheets, since the edges as they result from the previously mentioned cutting process would be dangerously sharp if they were not subjected to grinding.

The second reason relates to the elimination of the edge defects of the sheets, typically so-called microcracks, which might trigger breakages of the sheet in the subsequent working steps (in particular in the tempering step) as well as in the subsequent state of use (for example in the door or window).

The aesthetic aspect, which has a better performance in the execution subjected to grinding, should also not be dismissed.

In order to better understand the configuration of the glass sheet, not so much in its possible and in any case widespread isolated use but especially in its use in combination with other components to constitute the insulating glazing unit, some concepts related to the intermediate component itself, i.e., the glass sheet, and to the final product, i.e., the insulating glazing unit, are summarized hereafter.

The subsequent use of the insulating glazing unit, i.e., as a component of doors or windows, is known to the person skilled in the art and is not described here.

The use of the glass sheet, whether monolithic or laminated or armored, in the individual execution also has a considerable relevance in many applications in structural and interior decoration architecture.

With reference to FIG. 1, the insulating glazing unit is typically constituted by two or more glass sheets (1001, 1002) mutually separated by one or more spacer frames (1003), which are internally hollow and are provided with fine perforations on the face directed toward the inside of the chamber.

The spacer frames (1003), typically constituted by inorganic material, such as aluminum or stainless steel, or mixed inorganic and organic material, typically metal plus plastic, contain in their hollow part hygroscopic material, which is not shown in the figure.

The chamber (1006) delimited by the glass sheets (1001, 1002) and by the spacer frame (1003) can contain air or gas and or mixtures of gas injected therein, which give the insulating glazing unit particular properties, for example thermal insulation and/or soundproofing properties.

As an alternative, the spacer frames can be constituted by a profile made of expanded elastic organic material, such as for example silicone, which contains in its mass the hygroscopic material, or can be constituted by a profile made of extruded thermoplastic organic material, such as for example Ködimelt and Ködispace by Kömmerling, which contains the hygroscopic material within its mass.

Coupling between the glass sheets and the frame is obtained by means of two levels of sealing: the first seal (1004) is used to provide a hermetic closure and affects the lateral surfaces of the frame (1003) and the portion adjacent thereto of the glass sheets (1001, 1002); the second seal (1005) affects the compartment constituted by the outer surface of the frame and by the faces of the glass sheets up to their edge and has the function of providing cohesion among the components and of maintaining the mechanical strength of their mutual coupling.

FIG. 1 shows, in addition to the situation of the individual glass sheet 1F, five of the many possible sectional views of insulating glazing unit configurations 1A, 1B, 1C, 1D, 1E, only the first of which has been commented.

However, it is straightforward to extend the above description to the configurations 1B-1E, in which there are multiple frames and multiple glass sheets or glass sheets of various configuration, which are optionally laminated (i.e., composed of at least two glass sheets with interposed thermoplastic laminations).

In FIG. 1, the sun represents schematically the outside environment of a building in which the insulating glazing unit is installed, while the inside of the building is represented schematically by a radiator.

The upper representations (1A-1F) refer to the glass sheets as they are output by the described cutting operation, the lower representations (1As-1Fs) refer to the glass sheets as modified following the grinding or arrissing of their edges, to which the present disclosure relates.

The glass sheets, previously termed destination sheets, once obtained from the production formats, previously termed source formats, can in fact be used, as already mentioned: as they are, for example in the configuration of a monolithic sheet, i.e., constituted by a single thickness; in an annealed or tempered execution; as a laminated sheet, i.e., combined by the composition of two glass sheets of the monolithic type separated by a thermoplastic intermediate layer that is intimately bonded to them; as an armored sheet, i.e., combined by the composition of more than two glass sheets of the monolithic type separated by thermoplastic intermediate layers that are intimately bonded to them.

Alternatively, and as a more important extension, the glass sheets can be used in the composition of the insulating glazing unit provided with different configurations as a function of use, for example the glass sheet that is external with respect to the building (1001) can be normal or selective or reflective (in order to limit heat input during summer months) and also can be laminated/armored (for intrusion/vandalism prevention functions) or can be laminated/tempered (for safety functions) and can also be combined, for example reflective and laminated.

The glass sheet that is internal with respect to the building (1002) can be normal or of the low-emissivity type (in order to limit heat dispersion during winter months) and also laminated/tempered (for safety functions) as well as combined, for example low-emissivity and laminated.

Both the intermediate components (i.e., the glass sheets) and the finished product (i.e., the insulating glazing unit)

have the edges of the glass sheets that are accessible to contact with the hands of the operators and sometimes of the users.

It is therefore important to increase safety by rounding the peripheral margins of the glass sheets.

If the insulating glazing unit finished product, having a considerable added value with respect to the individual sheet, had sheet edges that could cut or sheets with a sharp edge as they are output by the cutting of the original sheet, it would be degraded in terms of safety, quality and commercial value.

From the simple summary presented, it is already evident that a manufacturing line for obtaining the insulating glazing unit product requires many processes in sequence and that each process requires a corresponding and particular machine to be arranged in series with respect to the other complementary ones.

Some processes or operations, by way of non-exhaustive example and at the same time not all necessary, are the following:

- EDGING, localized on the peripheral face of the glass sheet, of any coatings, in order to allow and maintain over time the adhesion of the sealants;
- GRINDING or ARRISSING, a particular innovative execution being the subject matter of the present disclosure;
- WASHING of the individual glass sheets, alternating an internal glass sheet with an external glass sheet (the orientation being the one defined above);
- APPLICATION OF THE SPACER FRAME: the frame, manufactured beforehand, filled with hygroscopic material and coated on its lateral faces with an adhesive sealant which has sealing functions, is applied to one of the glass sheets that constitute the insulating glazing unit in an appropriate station of the insulating glazing unit manufacturing line; as an alternative, as already mentioned, it is possible to use a profile made of elastic organic material or of thermoplastic organic material in order to form the frame directly and automatically against the face of at least one of the glass sheets;
- MATING AND PRESSING of the assembly constituted by the glass sheets and frame (or frames);
- FILLING WITH GAS of the chamber (or chambers) thus obtained; this operation is frequently performed in the same machine of the preceding process;
- SECOND SEALING The processes listed above can be performed by the respective machine automatically or semiautomatically, but in any case they sometimes entail contact of the intermediate components and of the finished products with the operator, for example during the step for loading and unloading the line and in subsequent steps for storage, transport, assembly to compose the door or window and installation of the door or window.

As regards the background art used in grinding with the use of abrasive belts, there is a manual process by means of which the glass sheets, rested on horizontal supporting surfaces, are moved into contact with grinding machines with flexible abrasive belts arranged sequentially and angularly offset so as to round both edges of the side of the glass sheet (methods of this type are described for example in DE 44 19 963).

EP 0 920 954 instead describes an apparatus for rounding with an automatic method cut glass sheets using a pair of flexible abrasive belts.

The greatest drawbacks arising from these known methods described above, both manual and automatic, relate to:

- the considerable bulk of the machines, the complex operations for process maintenance (such as the replacement of the abrasive belts);
- the less than optimum quality of the grinding operation;
- the abnormal behavior of the belt in interaction with the glass sheet when its width does not mate fully with the gas glass sheet (i.e., at the end of the side of the sheet);
- finally, the excessively long production times, unless machines with multiple working heads are used;
- in the case of automatic apparatuses (see for example EP 0 920 954), there is additionally the drawback of the excessive cost due to the complexity of the mechanisms as provided.

As regards the background art used in grinding with the use of abrasive grinding wheels, there are automatic machines and methods which are by now widespread, the most pertinent of which, both as potentially anticipating prior art and to highlight the inventive step of the present disclosure, is EP 1 769 885 B1, which has demonstrated successful application developments from 2005 to today.

However, although it eliminates the problems of the belt system, EP 1 769 885 B1 has the following limitations:

- impossibility to maintain synchronization of the horizontal axis, except for rather small formats of the glass sheets, conveyance along the horizontal axis occurring mainly by means of friction rollers;
- with consequent impossibility to process contoured glass sheets, except for rather small formats;
- complexity and therefore high cost of the machine;
- limited productivity;

There are further the more recent EP 2 039 464 B1 and EP 2 719 501 B1, which in turn have the following limitations:

- limited productivity due to the solution used in the processing cycle that uses sucker carriages, albeit independent, but arranged in series;
- complexity and therefore high cost of the machines, in particular if used only to grind the edges of the glass sheets, when they are conceived for complete milling over the entire thickness.

SUMMARY

The aim of the subject matter of the present application is therefore to solve the highlighted technical problems, eliminating all the drawbacks of the cited background art and thus providing a machine that allows to grind the edges of glass sheets safely and economically, obtaining a qualitative result that is superior to the one of the background art using flexible abrasive belts and equivalent to the one of the background art that uses rigid abrasive grinding wheels, but by resorting to a machine and to a method that are simpler and therefore more economical as well as more productive.

Within this aim, the present disclosure simplifies the mechanisms that constitute the automation of the grinding operation.

The present disclosure does not alter the structure of the insulating glazing unit production line, taking advantage of the modularity that typically characterizes it.

An important option is to ensure symmetric rounding of the edges, regardless of the surface and geometric irregularity of the edge of the glass sheet or of the laminated glass sheets produced by the operations for cutting the glass sheet into the formats required for final use; this is achieved simply by integrating the machine according to the present disclosure with the probe devices according to the above referenced title EP 1 769 885 B1.

The disclosure also optionally performs grinding in a manner that is substantially independent of the shape of the perimetric contour of the glass sheet.

The disclosure also increases productivity by reducing the processing time.

This aim, these advantages and others which will become better apparent from the description that follows are achieved by providing an automatic machine for grinding the edges of substantially planar glass sheets.

The machine is provided with a machine body (2*b*) with motorized support and conveyance rollers or belts (3*b*), an input conveyor (2*a*) with motorized support and conveyance rollers or belts (3*a*), an output conveyor (2*c*), with motorized support and conveyance rollers and belts (3*c*).

Furthermore, there are at least two means for conveying the glass is sheets (1), a lower one (100) and an upper one (200), which provide respectively the synchronous motions along a lower axis (X1) and an upper axis (X2), which engage and convey the glass sheets (1), which are interfaced alternately, for example the odd sheets with the lower conveyor means (100) and the even sheets with the upper conveyor means (200).

The main characterization is constituted by the synchronous movement mode of the glass sheets along the horizontal axis (X), since it is performed by resorting to two independent axes (X1 and X2) arranged in parallel and on each of which at least two carriages are arranged in series, each actuated with its own synchronous axis (X1*a*, X1*b*, X2*a*, X2*b*).

The two carriages are mutually spaced so as to support and convey the glass sheet in a stable condition which is such as to bear the loads induced by the working tools.

One axis, for example (X1), interacts with a glass sheet, for example the odd one, and the other axis, for example (X2), interacts with the subsequent glass sheet, for example the even one.

The relative motion between the working heads and the glass sheet (either of which or all of which can be in motion simultaneously in the case of glass sheets having a nonrectangular shape) constitutes, to import the etymology of machine tools, the so-called feeding or advancement motion.

Prior to mutual contact between the tool and the glass sheet, said relative motion assumes the name of registration or approach motion.

The peripheral motion of the grinding wheel tool, with reference to the rotation axis thereof is termed cutting motion.

Again to import the etymology of machine tools, the interference between the part of the space occupied by the glass sheet and the solid volume constituted by the tool is termed pass depth; this solid intersection corresponds to the part of the glass sheet that one wishes to remove by grinding and can be set by means of the machine parameters.

Advantageously, the glass sheet has a vertical arrangement, rests on a sliding surface and can move longitudinally on a conveyor.

The arrangement termed vertical is actually slightly inclined with respect to the vertical plane (generally by six degrees) in order to give static stability to the glass sheet, i.e., prevent its tipping; later on it will be termed pseudovertical.

BRIEF DESCRIPTION OF THE DRAWINGS

Further characteristics and advantages of the disclosure will become better apparent from the detailed description, given in the following chapter, of an embodiment of the disclosure, illustrated merely by way of nonlimiting example in the accompanying drawings, which are commented herein.

DETAILED DESCRIPTION OF THE DRAWINGS

Figure 1:
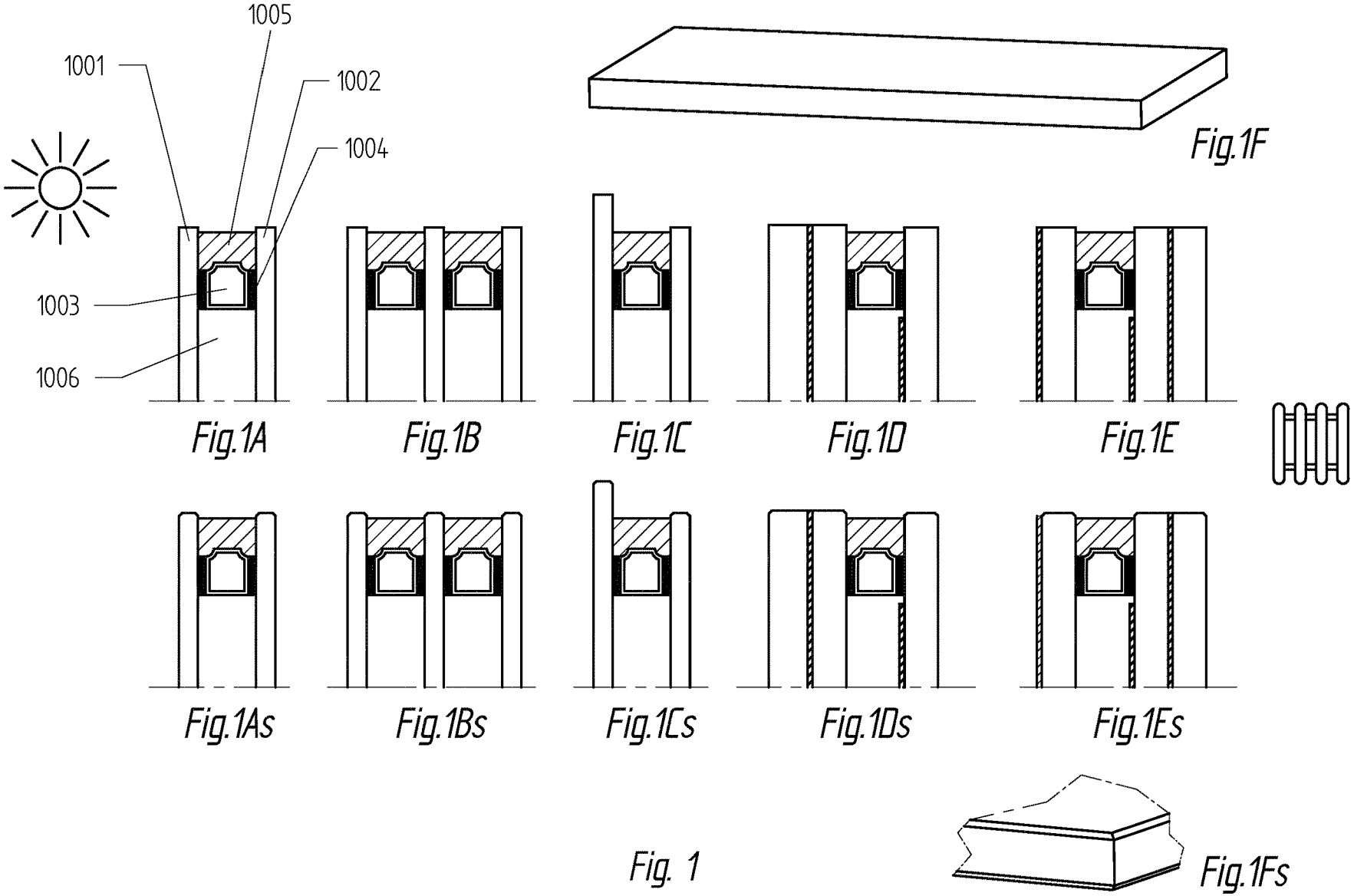
FIGS. 1A-1Fs contain perspective views of a single glass sheet and in partial cross-section of a series of typical insulating glazing unit configurations; these views are duplicated in order to show the sharp-edged shape and the ground or so-called arrissed shape obtained by means of a process which has high productivity by virtue of the innovation according to the present disclosure.
Figure 2:
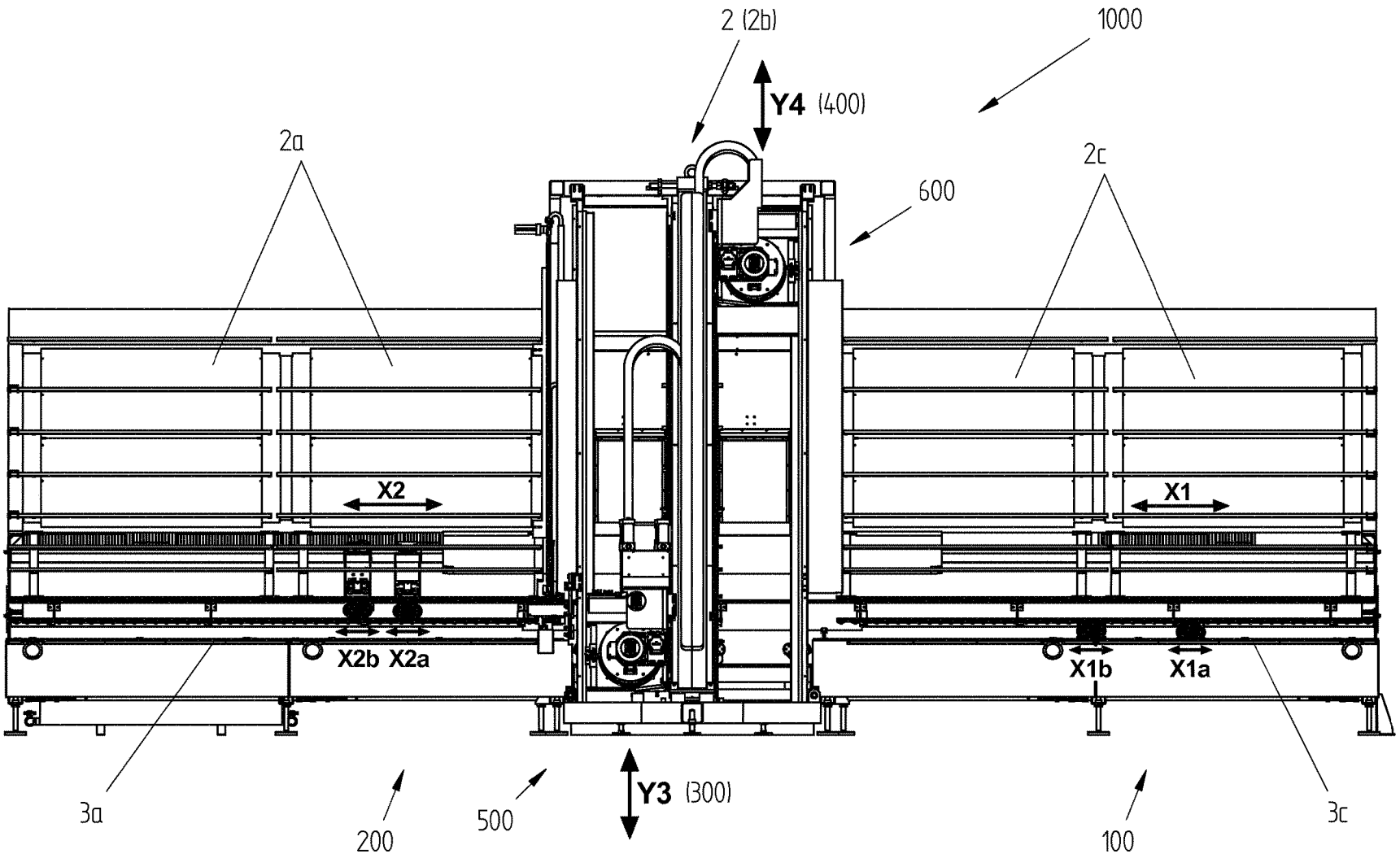
FIGS. 2, 3, 4 are views of the complete machine (automatic grinding or arrissing machine), which includes the subject matter of the present disclosure, respectively in its overall main views: front, top, side, with identification: of the horizontal axes (X0, X1 and X2), where X0 is actuated by the motorized pseudohorizontal conveyors of the known type with rollers or belts which act on the lower edge 1*c* of the glass sheet; X1 and X2 are actuated by virtue of conveyance means such as sucker carriages (assemblies 100 and 200), also of a known type as regards mechatronics but containing an inventive configuration, which act on the face of the glass sheet while it remains resting on a pseudovertical sliding surface provided with free rollers or with an air cushion; of the vertical axes (Y3 and Y4) actuated by means of carriages (assemblies 300 and 400), also of a known type; of the rotation axes of the working heads (ϑ5 and ϑ6 and corresponding assemblies 500 and 600), also of a known type.
Figure 3:
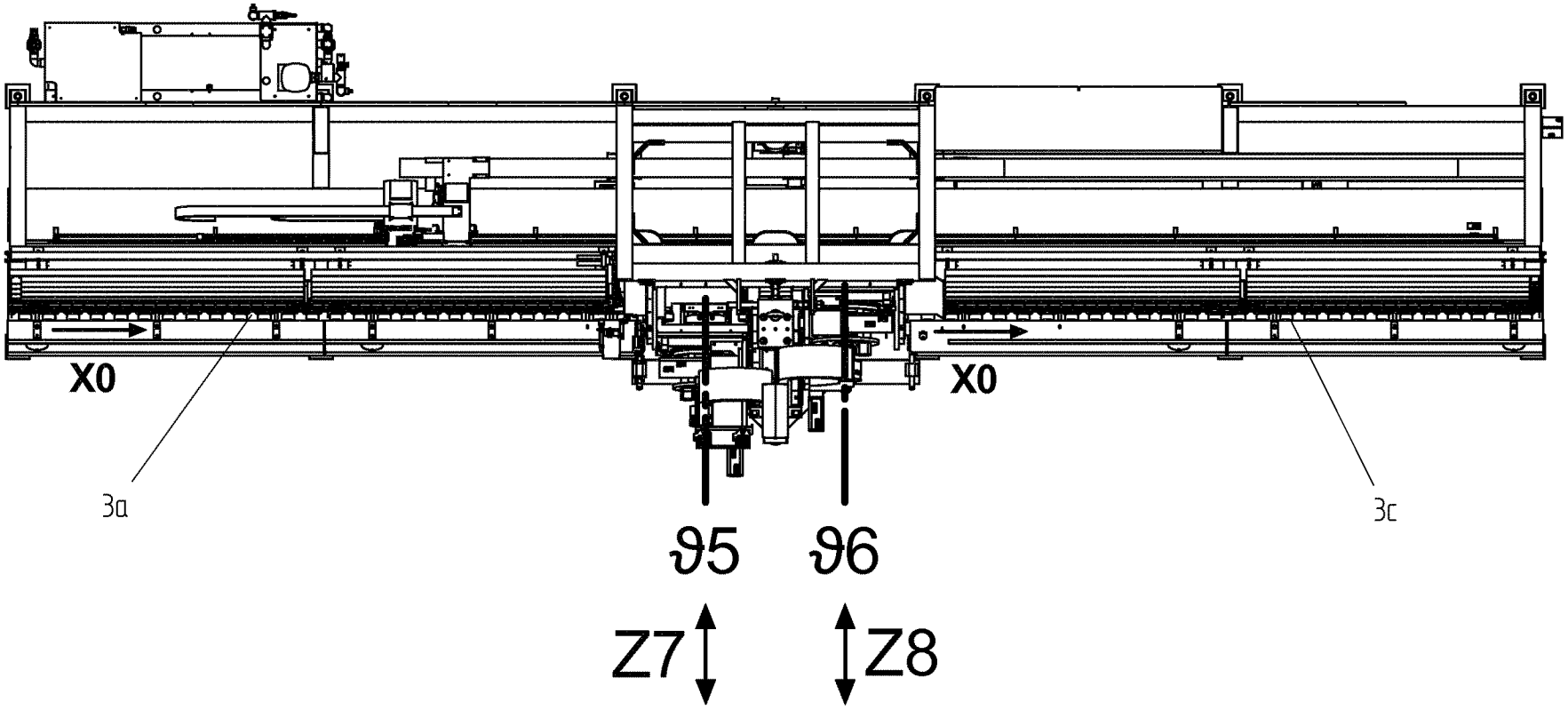

As described earlier, FIG. 1 is a schematic view of the cross-section of the peripheral portion of the insulating glazing unit according to an exemplifying series of possible combinations: normal configuration 1A, triple glazing unit 1B, staggered glass sheets 1C, laminated external sheet and low-emissivity internal sheet 1D, tempered reflective external sheet and laminated low-emissivity internal glass sheet 1E.

The two types of sealant used are highlighted: the butyl sealant 1004, which has a sealing function (first seal), applied between the lateral surfaces of the frame and the glass sheets, and the polysulfide or polyurethane or silicone sealant 1005 which has the function of providing a mechanical strength (second seal) and is applied between the outer surface of the frame and the inner faces of the glass sheets up to their edge.

FIGS. 1F and 1A-1E show that the individual glass sheet in its individual use and the insulating glazing unit even after second sealing have two external perimeters that are particularly dangerous due to the sharpness of the edges produced by the upstream process for cutting said glass sheets, whereas the corresponding FIGS. 1Fs and 1As-1Es it is evident that the situation can be improved by means of the milling process.

It is in fact known that the margin of the glass sheet obtained by mechanical cutting (scoring with a diamond tool and subsequent breakage by localized bending) has edges that can cut like a sharpened blade.

With reference to the accompanying figures, single-digit reference numerals, optionally combined with an index or a letter of the alphabet, designate some elements of the machine or of the process or of the product, so as to have an overview thereof, the reference numeral 1 being reserved for the glass sheet as the material that is the subject of the processes; two-digit reference numerals designate some complementary accessories; while the details and the constructive mechanisms are designated with three-digit reference numerals, optionally accompanied by a letter of the alphabet, the first digit of which is the digit of the main assembly to which they belong, said assembly as a whole being identified with a second and third digit equal to zero; four-digit reference numerals designate the components of the insulating glazing unit and the machines that belong to the line for its production.

All this is done to render the reading of the text and of the drawings schematic.

The reference numeral 1 identifies the individual glass sheet, the sides of which are indicated respectively: the vertical front side la, the horizontal longitudinal sides 1*b* the upper one and 1*c* the lower one (which are worked simultaneously for certain portions, unless the sides 1*b* and 1*c* are particularly short), and the vertical rear side 1*d*.

The description in fact begins, by simplification, by referring to glass sheets having a rectangular shape and then ends with the variations related to the cases of nonrectangular shapes.

The terms "front" and "rear" reference the direction of flow of the material that is being subjected to the processes, the glass sheet 1, within the line that is optionally provided with other processing stations, such as cutting and edging upstream and manufacture of the insulating glazing unit downstream.

The terms "front" and "rear" are also used for the working heads and for the tools again with reference to the direction of motion of the glass sheets (front as elements encountered first, rear as elements encountered second, with the exception of the elements of the series 100 and 200).

With reference to FIGS. 2 to 10 related to the machine according to an embodiment that is preferred in terms of economy of construction and to FIGS. 11*a*, 11*b* related to the optimization of the process, configurations which are superior to the situation of the background art, the essential components of this first preferred embodiment are described hereinafter, which can be extended both to the situation of complete working of the edge, i.e., affecting the entire thickness of the glass sheet, and in this case the grinding is termed milling, and to equivalent executions.

The described situation references the arrangement of the components that is such as to perform the method with the advancement direction of the glass sheet from left to right, an aspect which is irrelevant since the mirror-symmetrical arrangement for the case of right-to-left advancement direction is intuitive.

The machine comprises a main body 2*b* which is sequentially connected between two conveyors, an input conveyor 2*a* and an output conveyor 2*c*, which are respectively arranged upstream and downstream thereof.

The input conveyor 2*a* can be connected to an upstream processing station, for example the station for cutting the source glass sheet into destination sheets, or the edging station (machine for performing the removal of the peripheral band of the low-emissivity coating on the face of which the sealants must adhere), or as an alternative the glass sheet 1 to be ground may also be loaded manually or with the control of a handling unit or by means of an anthropomorphic robot on the input conveyor 2*a*.

The output conveyor 2*c* instead can be connected to a downstream processing section, for example the section in which the manufacture of the insulating glazing unit begins, in particular the washing unit, which must remove immediately the residues produced by the grinding process.

Figure 4:
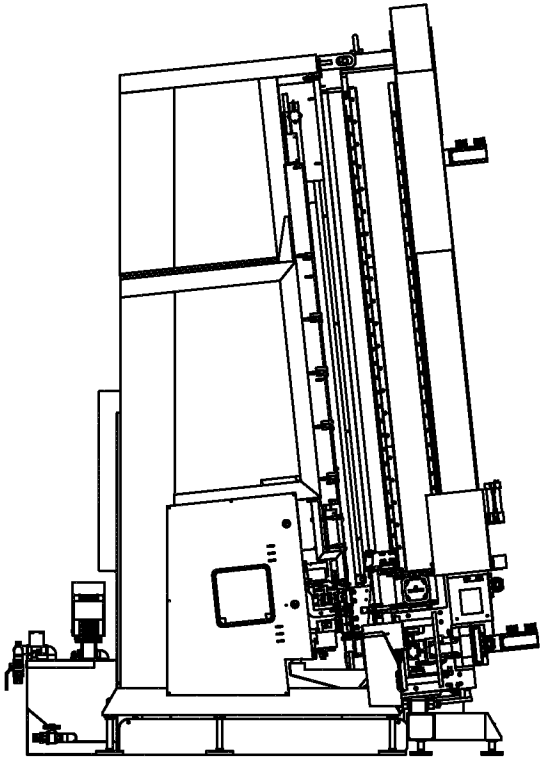
Figure 5:
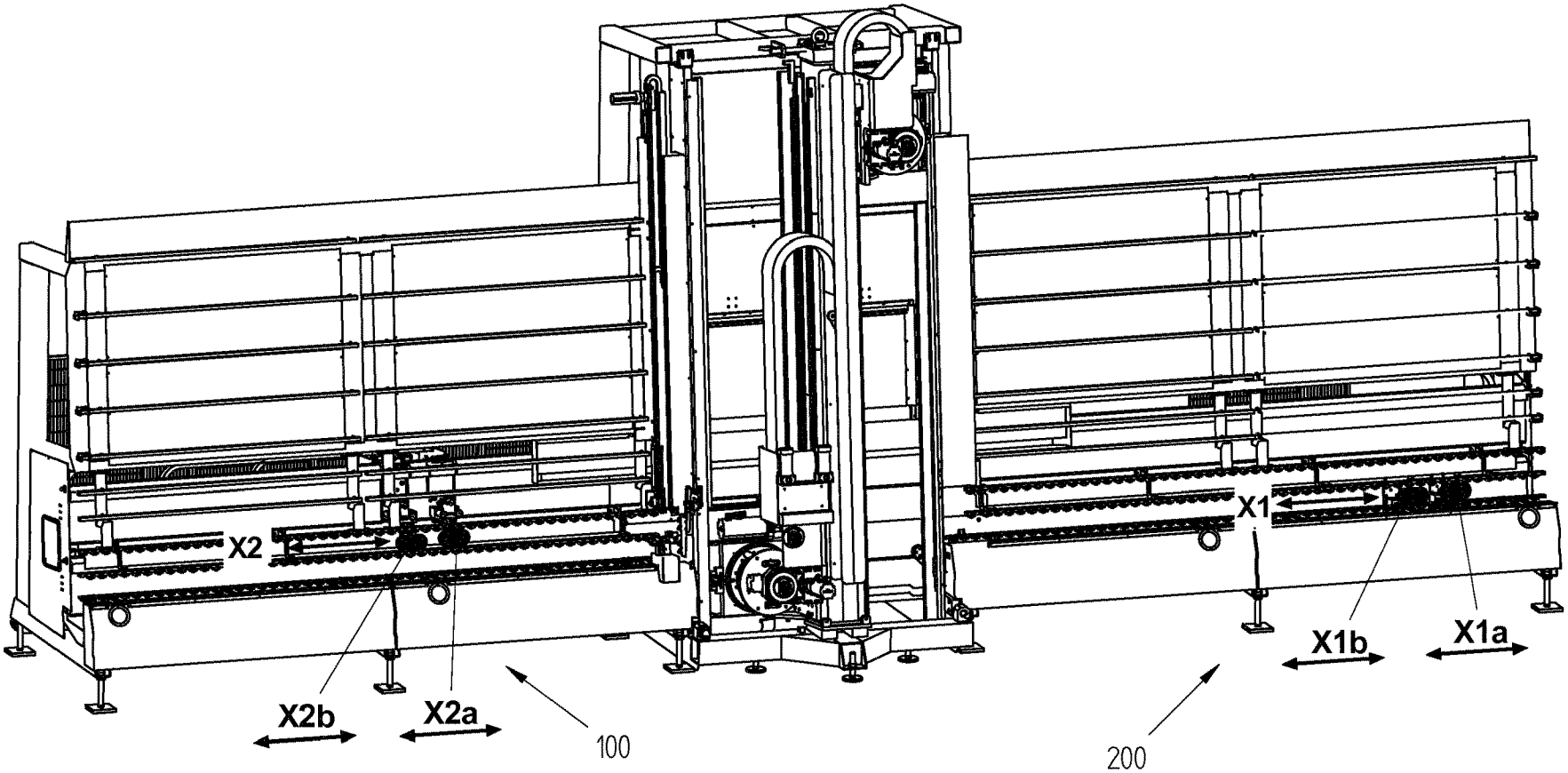
FIG. 5 is an overall perspective view of the machine, highlighting only the parts that constitute the inventive concept (axes X1 and X2 and corresponding assemblies 100 and 200), for its summary identification.

Both conveyors, as well as the central machine body, keep the glass sheet at an inclination of approximately six degrees with respect to the vertical, as can be seen in FIG. 4.

The machine can also be used autonomously, for example for grinding glass sheets independently of the preceding and subsequent processes, i.e., not connected to other machines, except to the washing unit for the above cited reason.

The input conveyor 2*a* and the output conveyor 2*c* comprise a base for supporting the lower edge of the glass sheet, on which there is a series of motorized support and conveyance rollers or belts of the known type 3*a*, 3*b*, 3*c*.

The conveyor further comprises a resting surface, provided with free rollers or with an air cushion, on which the glass sheet is rested substantially vertically in the sense mentioned earlier.

The conveyors are widely known and therefore are not discussed here in detail.

The input conveyor preferably comprises a thickness detector of a known type for measuring the thickness of the glass sheet to be worked before it enters the grinding sections, in order to provide a signal for the initial approach of the abrasive tools to the glass sheet 1 as a function of its thickness.

It further comprises a detector of the height of the glass sheet, the signal of which constitutes the input for the active strokes of the vertical axes Y3, Y4.

The same detector can be arranged as an alternative in the working heads.

These detectors can be omitted or bypassed if the corresponding output values are not necessary since they are transferred to the machine, via network or on a solid electronic medium, as data entry arriving from an information/management system.

The machine body 2*b* is of the known type and is constituted by a resting surface with a pseudovertical arrangement with free rollers for the resting and sliding of the glass sheet 1 and free or motorized rollers with a pseudohorizontal arrangement.

Along the conveyors 2*a*, 2*b* and 2*c*, practically through the overall machine body 2 on the rear side, with respect to the glass sheet 1, there are two superimposed rows of double superimposed tracks with a longitudinal extension 100, 200 for guiding groups of sucker carriages which move independently but in a coordinated manner, typically two groups for each double track, but this quantity is nonlimiting.

The corresponding sliding axes are designated by X1 for the lower one and X2 for the upper one.

In the machine body there are the at least two vertical carriages 300, 400 which move independently but in a coordinated manner along the vertical axes Y3, Y4, these carriages being provided with the working heads 500, 600 provided with rotation axes ϑ5 and ϑ6 and with adjustment axes Z7 and Z8.

All the referenced axes X1, X2, Y3, Y4, ϑ5, ϑ6 are actuated by synchronous and interlinked actuations for the reasons that will be described hereinafter.

The more detailed description presents the splitting of the axis XI into X1*a* and X1*b* and of the axis X2 into X2*a* and X2*b*.

The additional axes Z7 and Z8, actuated by means of traditional components 700, 800, move transversely the electric spindles 507, 607 for the centering of the tools 509, 609 and of the probes 510, 610, as a function of their type and of the thickness of the glass sheet; these are axes which are provided with feedback but are not interlinked.

The jaws for the retention of the flap of the glass sheet 1 are instead: the fixed one 511, 611 and the corresponding roller 513, 613 aligned with the surfaces 2*a*, 2*b*, 2*c*, the movable one 512, 612 and the corresponding roller 514, 614 with closure actuated by a force-controlled actuator, with logic-controlled intervention and not in a synchronous tie, in order to open and is close according to the operating cycle.

The axes X1 and X2 in turn are paired with an axis X0, which is synchronous or almost synchronous with X1 and X2, which actuates the conveyance of the lower flap 1*c* of the glass sheet 1, by means roller or belt devices on which the glass sheet 1 in any case rests during the grinding (or arrissing) processes.

The glass sheet 1 that arrives from the preceding processing machine, or loaded as mentioned earlier on the input conveyor 2*a* of the machine, is made to advance, conveyed by the support and conveyance rollers of the known type, to the grinding station.

The phase arrangement of the vertical side 1*a* of the glass sheet occurs by means of the signal of a sensor, after the synchronous axis X1*a* has coupled, by means of the sucker 112*a*, to the rear face of the glass sheet 1 and simultaneously or just after the synchronous axis X1*b* has coupled, by means of the sucker 112*b*, to the rear face of the glass sheet 1.

The offset between the sucker 112*a* and the sucker 112*b* is optimized according to the length of the glass sheet 1 so as to give stability thereto toward the action of the force of gravity and the action of the thrust of the tool that is working.

The movements described herein are performed by means of the following mechatronic components, all of which are evident, respectively in the figures that follow.

Figure 6:
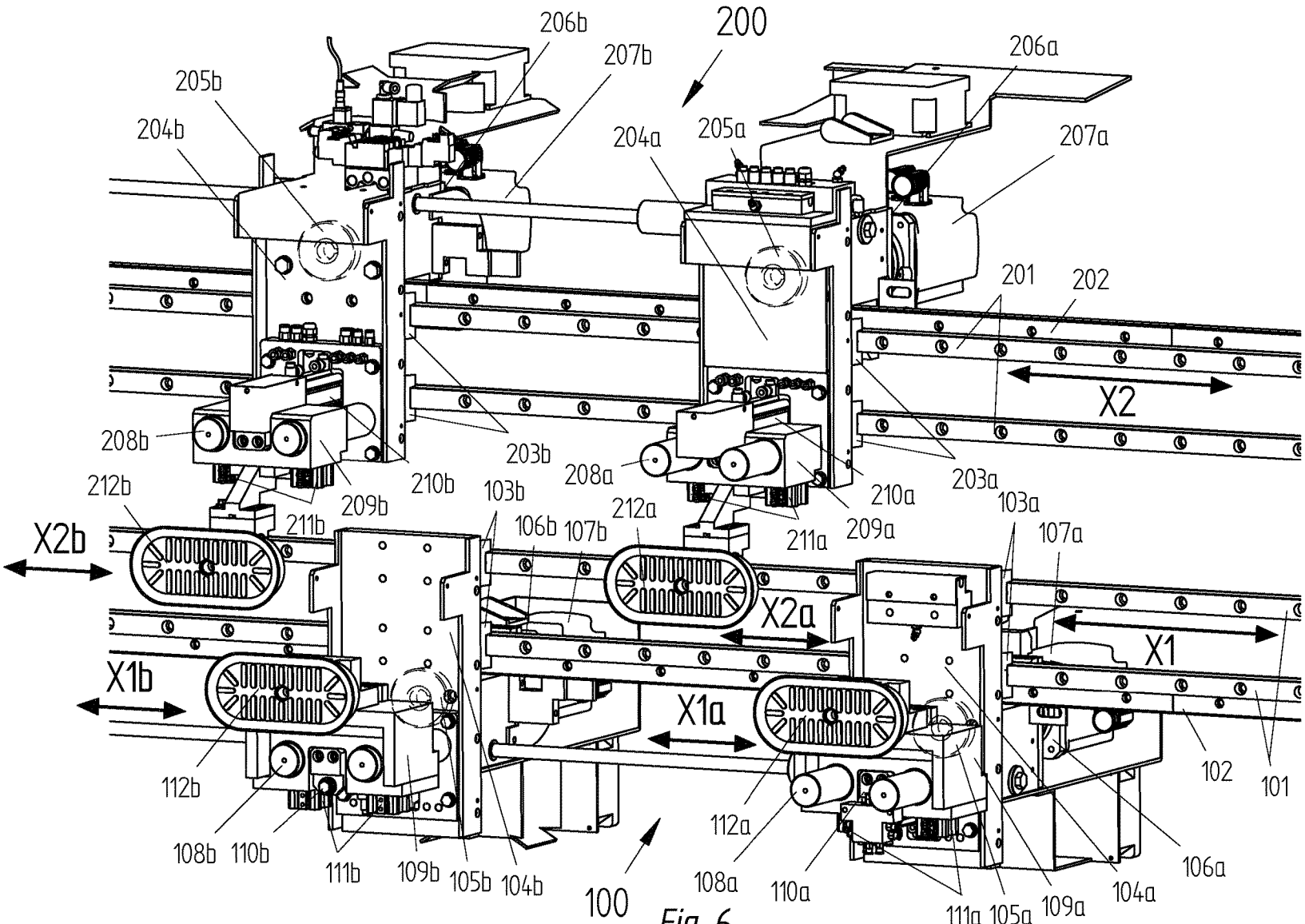
FIG. 6 is a perspective detail view of the distribution of the components that constitute the inventive concept (axes X1, X1*a*, X1*b* and X2, X2*a*, X2*b* and corresponding assemblies 100 and 200).

In FIG. 6 for the axes X1*a* and X1*b*: guides 101, rack 102, sliders 103*a* and 103*b*, longitudinal carriages 104*a* and 104*b*, pinions 105*a* and 105*b*, reduction units 106*a* and 106*b*, synchronous motors 107*a* and 107*b*, transverse guides 108*a* and 108*b*, transverse carriages 109*a* and 109*b*, pneumatic cylinders 110*a* and 110*b*, stem locking pneumatic cylinders 111*a* and 111*b*, suckers 112*a* and 112*b*.

For the axes X2*a* and X2*b*: guides 201, rack 202, sliders 203*a* and 203*b*, longitudinal carriages 204*a* and 204*b*, pinions 205*a* and 205*b*, is reduction units 206*a* and 206*b*, synchronous motors 207*a* and 207*b*, transverse guides 208*a* and 208*b*, transverse carriages 209*a* and 209*b*, pneumatic cylinders 210*a* and 210*b*, pneumatic stem locking cylinders 211*a* and 211*b*, suckers 212*a* and 212*b*.

In FIG. 6 the suckers 112*a*, 112*b*, 212*a*, 212*b* are shown in individual execution; it goes without saying that the individual sucker might be replaced with two or more suckers, for example in order to extend the grip range toward the glass sheet.

Figure 7:
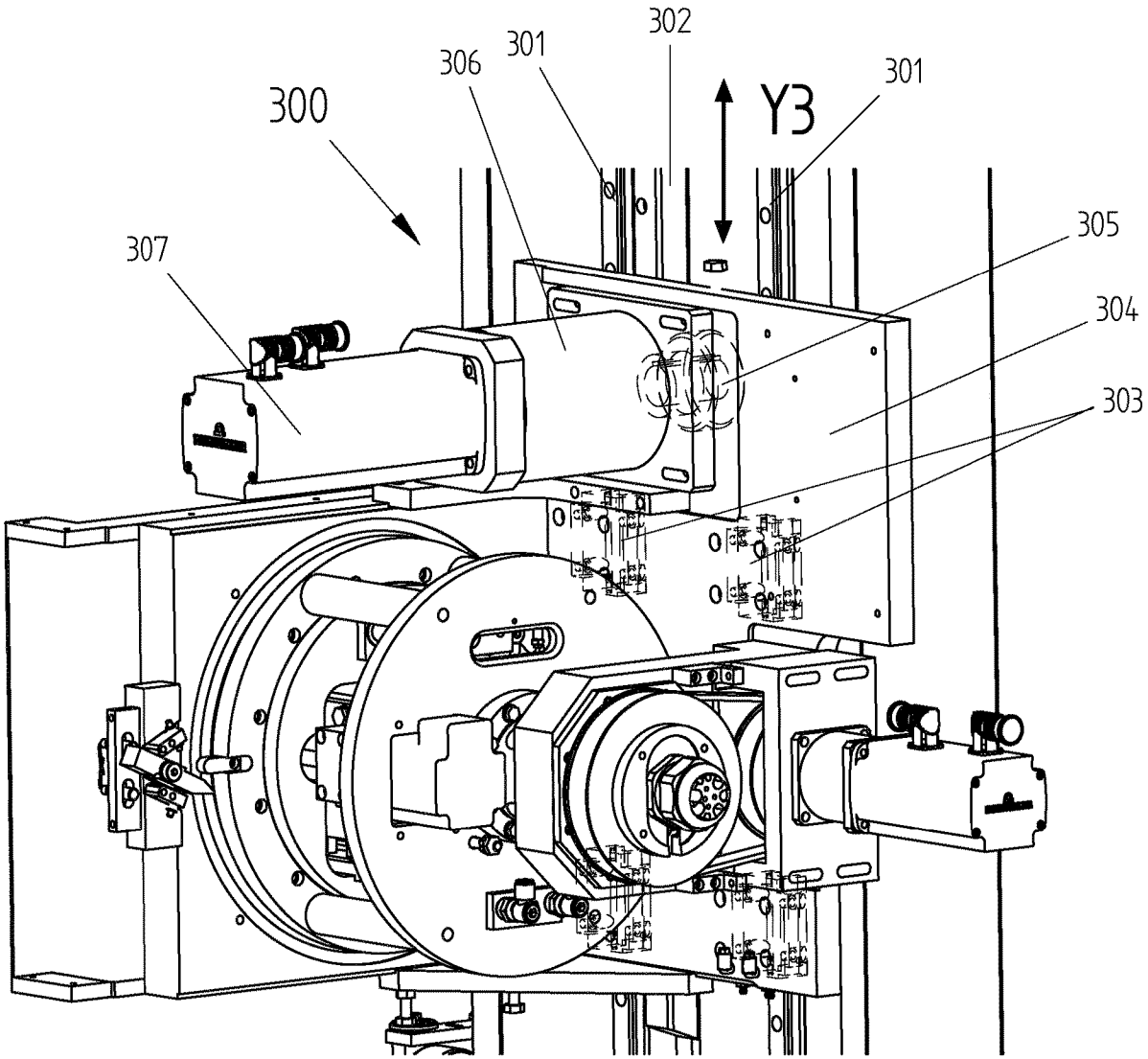
FIG. 7 is a perspective detail view of the components that constitute the vertical carriage of the first working head (axis Y3 and corresponding assembly 300).

In FIG. 7 for the axis Y3: guides 301, rack 302, sliders 303, vertical carriage 304, pinion 305, reduction unit 306, synchronous motor 307.

Figure 8:
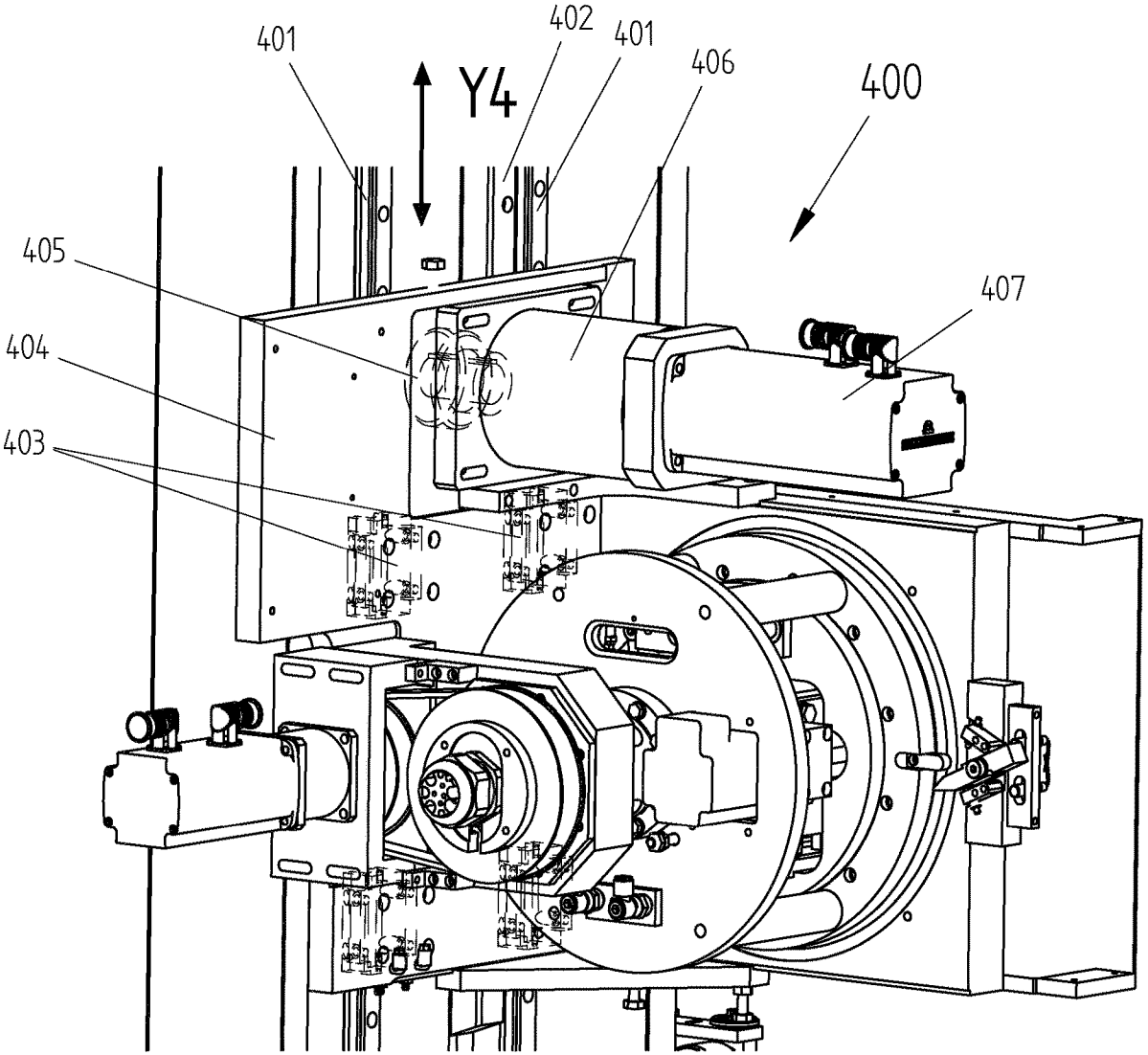
FIG. 8 is a perspective detail view of the components that constitute the vertical carriage of the second working head (axis Y4 and corresponding assembly 400).

In FIG. 8 for the axis Y4: guides 401, rack 402, sliders 403, vertical carriage 404, pinion 405, reduction unit 406, synchronous motor 407.

Figure 9:
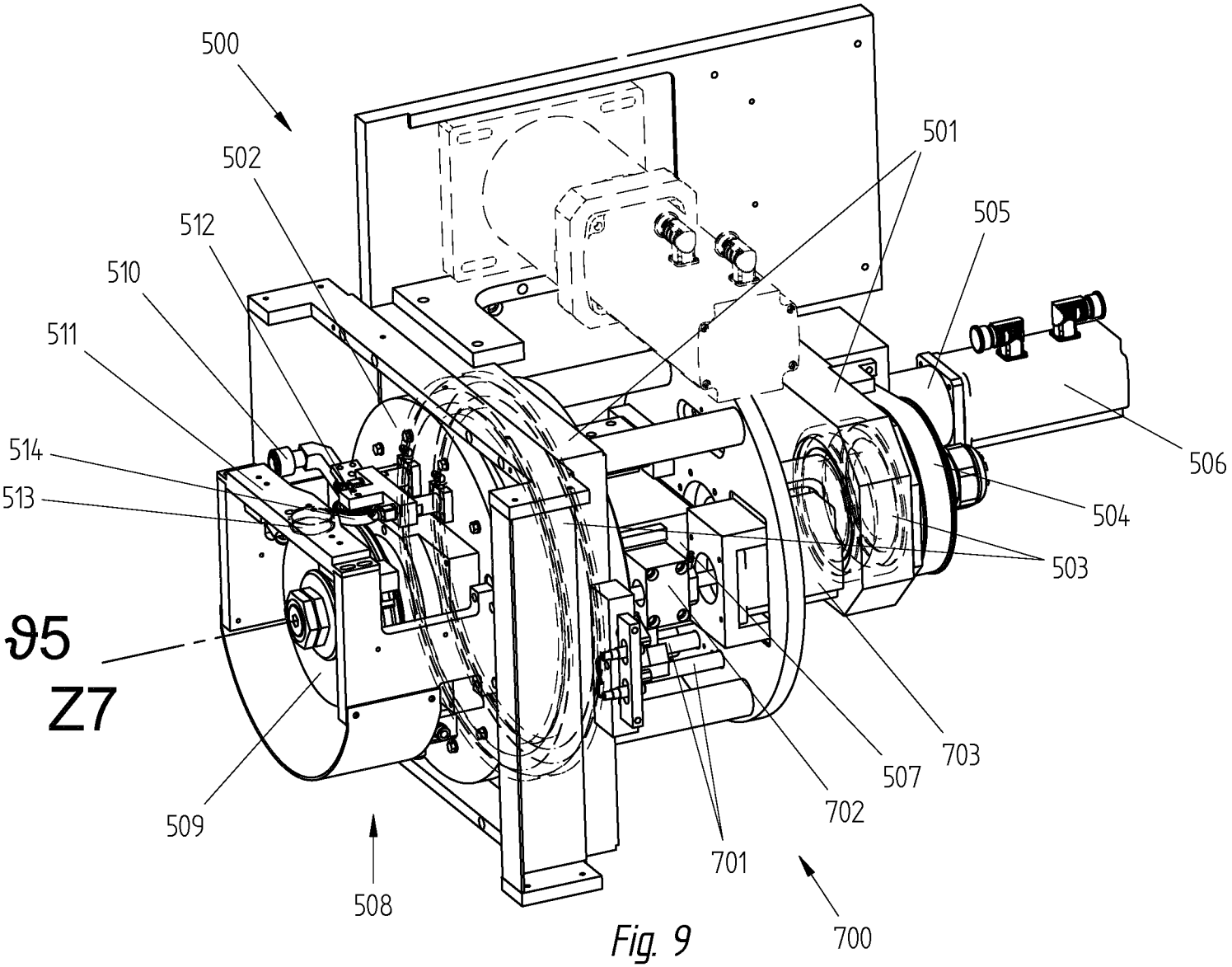
FIG. 9 is a perspective detail view of the components that constitute the first working head (axes ϑ5 and Z7 and corresponding assemblies 500 and 700).

In FIG. 9 for the axis ϑ5: fixed body 501, rotating body 502, bearings 503, belt drive 504, reduction unit 505, synchronous motor 506, electric spindle 507; for the axis Z7: guides 701, ballscrew 702, step motor 703, for the centering of the tool 509 and of the probe 510, as mentioned earlier.

Figure 10:
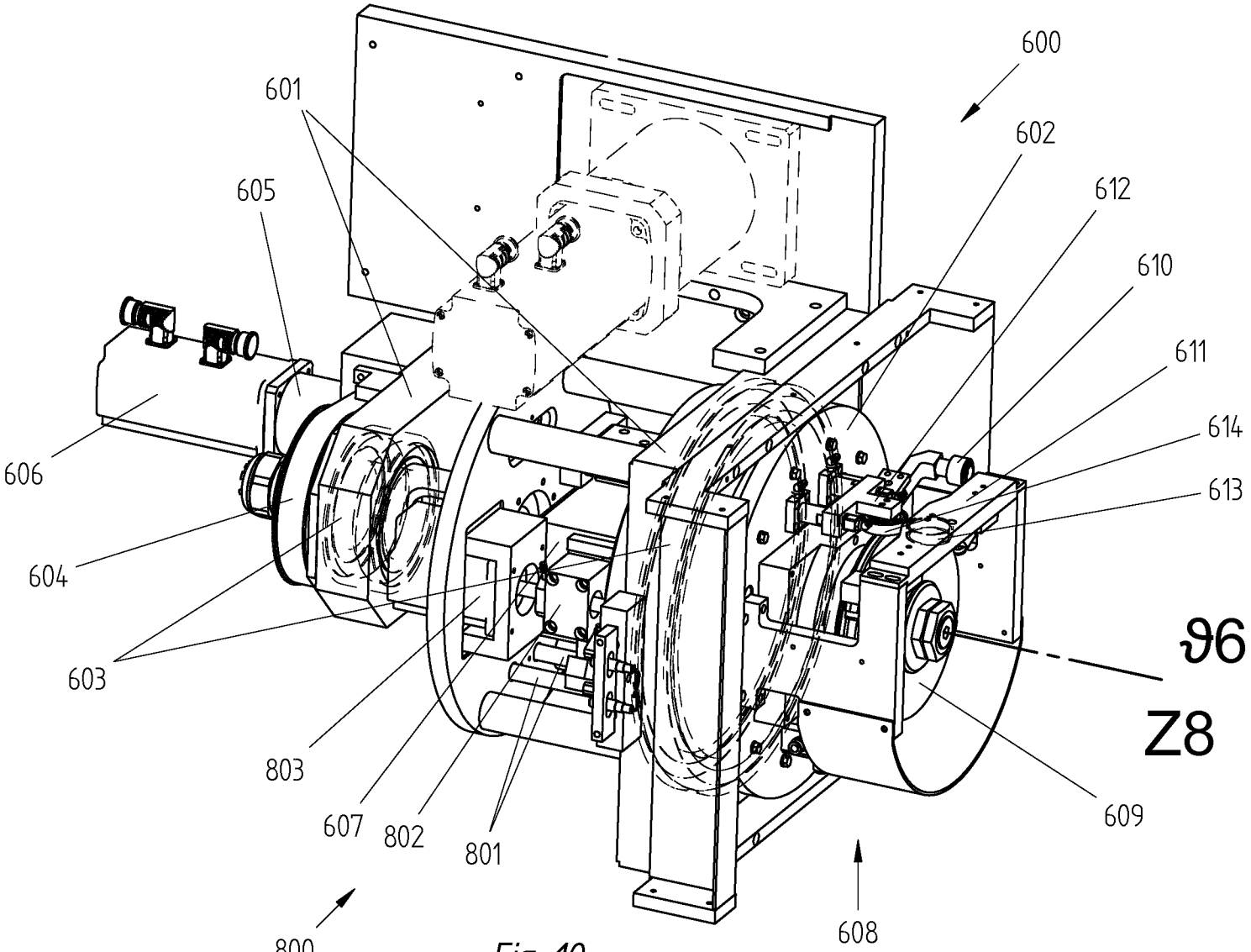
FIG. 10 is a perspective detail view of the components that constitute the second working head (axes ϑ6 and Z8 and corresponding assemblies 600 and 800).

In FIG. 10 for the axis ϑ6: fixed body 601, rotating body 602, bearings 603, belt drive 604, reduction unit 605, synchronous motor 606, electric spindle 607; for the axis Z8: guides 801, ballscrew 802, step motor 803, for the centering of the tool 609 and of the probe 610, as mentioned earlier.

For the continuity of the vertical resting, the vertical plane with free rollers for the sliding of the input conveyor 2*a* and output conveyor 2*c* is resumed in the section 2*b* described earlier, in the region that is not occupied by the working heads; likewise the support of the lower flap 1*c* of the glass sheet, optionally integrated with conveyance means, is resumed in the section 2*b*, again in the region that is not occupied by the working heads, this being done also to allow the transit of the glass sheets 1, up to a minimum value of the length of their base 1*c*, for which the grinding process is not required.

Figure 11A:
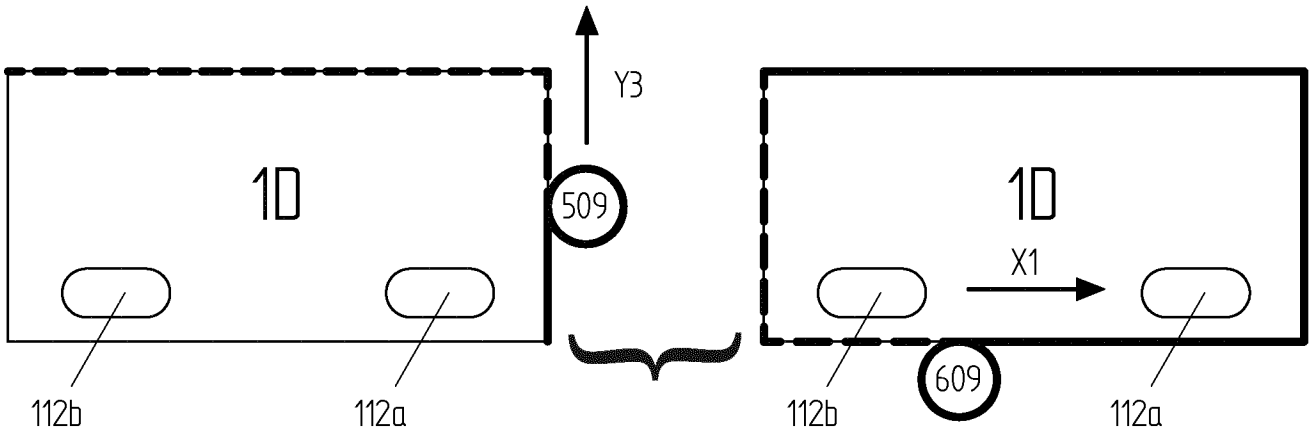
FIGS. 11*a* and 11*b* show the diagram of the process for working the odd glass sheet (1D) and the subsequent even glass sheet (1P) in the interaction with the logic system of the axes X1 by means of the corresponding suckers (112*a*, 112*b*) and X2 by means of the corresponding suckers (212*a* and 212*b*); the thin mark indicates the perimeter of the glass sheet, the solid bold mark indicates the already ground part, the dashed bold mark indicates the part that will be ground in the represented working station.
Figure 11B:
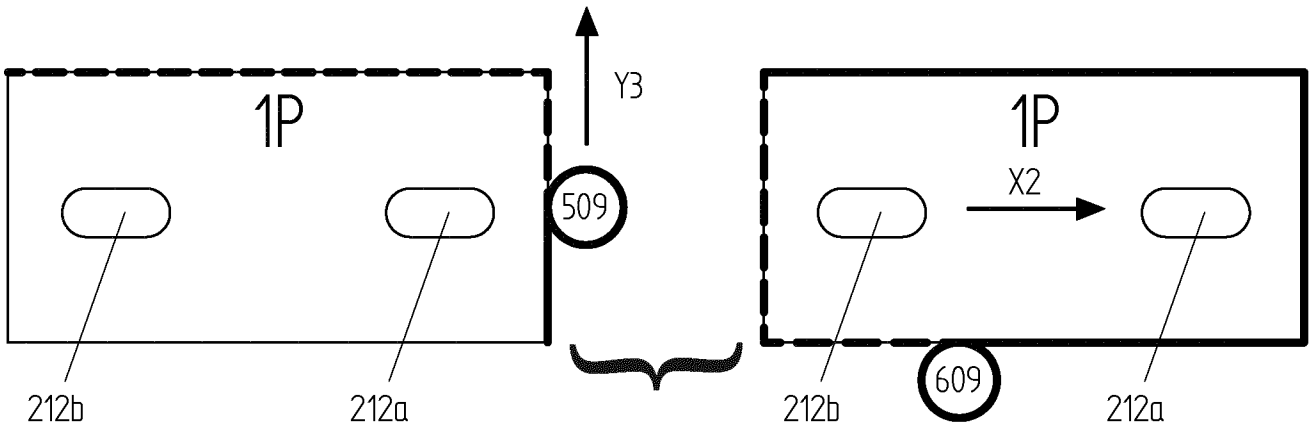

For the description that follows, which refers to the sequence and the operating mode of the mechatronic mechanisms, it is useful to reference FIGS. 11*a* and 11*b*.

By using the axis X0 and the mechanisms described above, the odd glass sheet 1D (the case of the rectangular glass sheet is described for now) is conveyed up to the section in which the sucker carriages 104*a* and 104*b* operate and once it has been coupled to the suckers 112*a* and 112*b* its horizontal translation, which constitutes the feeding or advancement motion, is entrusted to the synchronous axes X1*a* and X1*b* with a phase arrangement that is adapted to begin the working of its vertical side 1*a* by means of the working head 500, 508, provided with a translational motion, which constitutes the feeding or advancement motion, entrusted to the carriage 300 and the corresponding synchronous axis Y3.

Once the working of the vertical side 1*a* has ended, the working head 500, 508 rotates the mechanisms for centering and retaining the flap of the glass sheet through ninety degrees, by virtue of the synchronous axis ϑ5, so as to orient it according to the arrangement of the upper side 1*b* of the glass sheet 1D.

The synchronous axes X1*a* and X1*b* then make it translate horizontally, with a feeding or advancement motion, allowing the working head 500, 508 to work the side 1*b* and, as the lower side 1*c* arrives at the second working head 600, which is kept fixed in its lower position, said second head begins to work the lower side 1*c* and continues working until the vertical rear side 1*d* appears, for the working of which the working head 600 rotates the mechanisms for the centering and retention of the flap of the glass sheet through ninety degrees by virtue of the synchronous axis ϑ6, so as to orient it according to the arrangement of the rear side 1*d* of the glass sheet 1D, for the working of which the working head 600, 608 is translated vertically upward, with a feeding or advancement motion, by virtue of the carriage 400 and the corresponding synchronous axis Y4.

Once the working head 500, 508 has ended the working of the upper horizontal side 1*c*, which occurs a little before the vertical working performed by the working head 600, 608, the working head 500, 580 returns to its lower stroke limit position by virtue of the carriage 300 moved by the synchronous axis Y3 and the orientation of the mechanisms for the centering and retention of the flap of the glass sheet is set by virtue of the axis ϑ5 to be prepared for the subsequent working of the front vertical side 1*a* of the subsequent even glass sheet 1P.

Once the working head 600, 608 has ended the working of the rear vertical side 1*d*, the working head 500, 580 returns to its lower stroke limit position by virtue of the carriage 400 moved by the synchronous axis Y4 and the orientation of the centering and retention mechanisms of the flap of the glass sheet is set by virtue of the axis ϑ6 to be prepared for the subsequent working of the lower horizontal side of the subsequent even glass sheet 1P.

The progressive working, without discontinuity in the conveyance of all the queued glass sheets along the horizontal longitudinal axis X0, and therefore in a condition of high productivity, is allowed by virtue of the duplication of the horizontal longitudinal synchronous conveyance axes X1 and X2, so that, while for example the odd glass sheet 1D is being worked by means of the two working hands, and therefore by means of the tools 509 and 609, coupled with the sucker carriages 112*a* and 112*b* controlled by the axis X1, the sucker carriages 212*a* and 212*b* controlled by the axis X2, which are now free from the preceding process, can, with a movement of the pilgrim pitch type, move backward in order to engage the subsequent even glass sheet 1P, and so forth.

The uncoupling of the suckers 112*a*, 112*b* or 212*a*, 212*b* from the face of the glass sheet is performed not only by the deactivation of the vacuum but by the transverse spacing stroke with respect to said face performed by transverse guides 108*a*, 108*b* or 208*a*, 208*b*, transverse carriages 109*a*, 109*b* or 209*a*, 209*b*, pneumatic cylinders 110*a*, 110*b* or 210*a*, 210*b* and interlocks of the stem locking pneumatic cylinders 111*a*, 111*b* or 211*a*, 211*b*.

Having described all the essential components of the preferred embodiment of the machine, and having developed the method of operation thereof according to the diagram of FIGS. 11*a* and 11*b* for what we can term OPTION 1: working of a rectangular glass sheet 1 in high productivity conditions, one moves on now to describing, in terms of differences, the work process in the following options, all of which are possible by using the described mechanisms, a logic system for their control, flexible software for the management of said logic system, albeit in a situation of lower productivity with respect to OPTION 1, which is in any case functional and still utilizes the inventive concept.

OPTION 2: working of a rectilinear contoured glass sheet 1';

OPTION 3: working of a mixed rectilinear/curvilinear contoured glass sheet 1";

OPTION 4: working of a curvilinear contoured glass sheet 1'";.

All the descriptions resume from the already described position of arrangement of the glass sheet 1', 1", 1'" at the front working head (assembly 500).

OPTION 2: the working head 500 with its tool 509, in this case using the axes Y3 and ϑ5 in interpolation with each other and in interpolation with the axis X1 that translates the glass sheet 1D by means of the suckers 112*a* and 112*b*, perform grinding along the entire peripheral path of the rectilinear sides 1*a*, 1*b*, 1*d*, and the additional ones for figures from pentagonal onward, and the working head 600 with its tool 609 performs the grinding of the side 1*c*, from the moment when the vertex between the side 1*a* and the base side 1*c* reaches the tool 609.

An alternative combination is that the working head 600 with its tool 609 performs grinding also of the side 1*d*, as described in OPTION 1 to increase productivity instead of the working head 500 and the corresponding tool 509, and in this case by interpolation of the axes Y4, ϑ6 and X1.

Figure 12D:
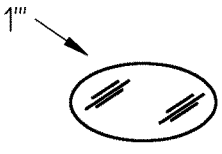
FIGS. 12*a*, 12*b*, 12*c*, 12*d* show the shapes of the glass sheets that can be worked with the machines and the method according to the present disclosure.
Figure 12C:
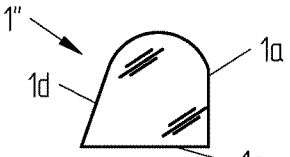
Figure 12B:
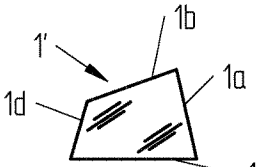
Figure 12A:
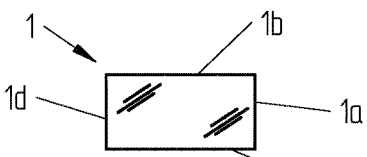
Figure 13:
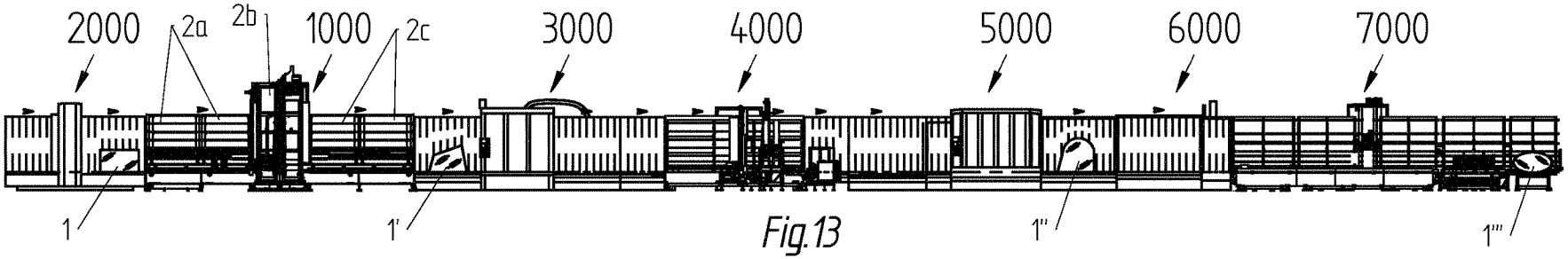
FIG. 13 is a view of an example of insertion of the machine according to the disclosure in the insulating glazing unit production line (in the front is elevation view).
Figure 14:
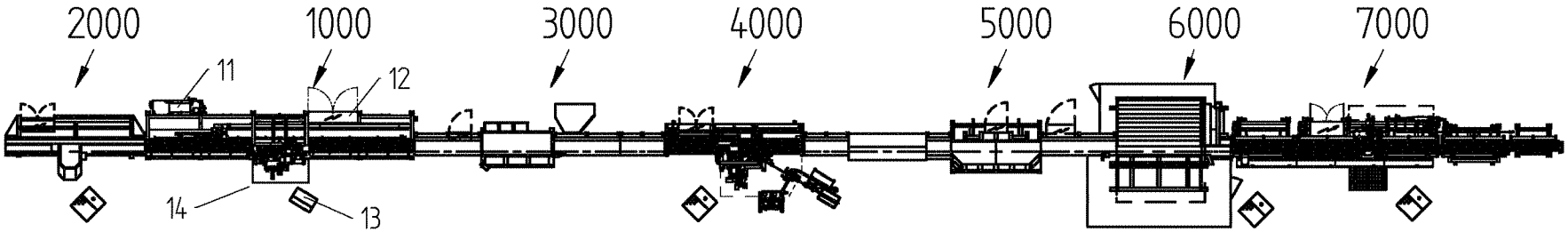
FIG. 14 is a view of an example of insertion of the machine according to the disclosure in the insulating glazing unit production line (in the plan view) and includes the identifications of the main body (2*b*), of the input conveyors (2*a*) and output conveyors (2*c*), of the water treatment system (11), of the electrical/electronic panel (12), of the control post (13), of the safety devices (14).

OPTION 3: the working head 500 with its tool 509, in this case by using the axes Y3 and ϑ5 in interpolation with each other and in interpolation with the axis X1 that translates the glass sheet 1D by means of the suckers 112*a* and 112*b*, perform grinding along the entire peripheral path of the mixed rectilinear and curvilinear sides (FIG. 12*c* is an example which does not exhaust the various possible cases) and the working head 600 with its tool 609 performs the grinding of the side 1*c*, from the moment when the vertex between the front side and the base side 1*c* reaches the tool 609.

An alternative combination is that the working head 600 with its tool 609 performs grinding also of the side 1*d*, as described in OPTION 1 to increase productivity, instead of the working head 500 and the corresponding tool 509, and in this case by interpolation of the axes Y4, ϑ6 and X1.

OPTION 4: in this case either the working head 500 with its tool 509 or the working head 600 with its tool 609 performs the entire relative path of the perimeter of the glass sheet 1D in order to grind it, while said sheet 1D is retained and conveyed by means of the suckers 112*a* and 112*b* along the axis X1.

This path is performed by means of the interpolation of the axes: X1 indeed and Y3 and ϑ5, or X1 and Y4 and ϑ6.

Like OPTION 1, also for OPTIONS 2 to 4 while for example the odd glass sheet 1D is being worked by means of the two working heads (or only one of them for OPTION 4), and therefore by means of the tools 509 and 609, or only one of them for OPTION 4, coupled to the sucker carriages 112*a* and 112*b* controlled by the axis X1, the sucker carriages 212*a* and 212*b* controlled by the axis X2, which at this point are free from the preceding process, can, with a movement of the so-called pilgrim pitch type, move backward in order to engage the next even glass sheet 1P, and so forth.

INDUSTRIAL APPLICATION

It goes without saying that the industrial application is assuredly successful, since the machines for the process for grinding/arrissing, milling and polishing of the edge of the glass sheets are importantly topical.

Moreover, the market of insulating glazing is growing continuously, since in recent years it has been increased by all those configurations that resort to the use of special glass sheets such as the ones described in the introduction and in particular tempered ones, which require necessarily at least the grinding of the sharp regions of the edge as produced by the cutting operations as a preparatory step for tempering.

Moreover, the many processes of the glass sheets when they are single and of the insulating glazing unit as a combination of at least two individual glass sheets spaced by at least one spacer frame would be risky if the operators did not use personal protection devices, albeit necessary due to the presence of sharp edges, or on the other hand might instead be performed without the use or with limited use of personal protection devices in the situation in which said sharp edges are rounded by the machine according to the present disclosure.

Therefore, at least the rounding, the so-called arrissing of the edges is a very important added value which qualifies the product.

This operation, indeed due to the vast demand, in particular for glass sheets intended for tempering and in any case for accident prevention purposes, must be performed in a massive quantity and with processing times which are minimized and with machines the cost of which is modest.

Moreover, the diffusion of shapes which are nonrectangular, since they are polygonal or curvilinear or mixed, increases even more the importance of a version of the present disclosure, against the limitation of many traditional machines that can process only rectangular shapes.

The particular arrangement of working heads 500, 600, in connection with the duplication and independence of the sucker carriages 112*a*, 112*b* and 212*a*, 212*b* such as the one shown in FIGS. 11*a* and 11*b*, of the machine according to the present disclosure, further has substantially halved the cycle times with respect to the background art.

Moreover, a field which is constantly developing and is parallel to the field of insulating glazing units and also requires grinding of the edges or of the entire perimetric contours of glass sheets 1 is constituted by the tempering of glass sheets for many different uses other than the double glazing unit sector, in particular in architecture, in interior decoration and for electric household appliances.

It has thus been shown that the machine according to the disclosure achieves the intended aims and advantages.

The disclosure is susceptible of numerous modifications and variations, all of which are within the scope of the appended claims.

Thus, for example, the mechanical solutions for the tool feeding motions, for the support and traction of the glass sheet and the actuation means may be electric, electrical-electronic, pneumatic, hydraulic and/or combined, while the control means can be electronic or fluidic and/or combined.

An important constructive variation is the one constituted by the logical combination of the actuations respectively for translation of the glass sheet 1, for movement of the working heads 500, 600 so as to allow the working of glass sheets that are contoured 1', 1", 1'", i.e., have shapes other than rectangular.

To achieve this, as described earlier, the electronic drives of the motors dedicated to the axes X0, X1, X2, Y3, Y4, ϑ5, ϑ6 are concatenated by means of an electrical tie, and interlinked with a numeric control.

The tools 509, 609 also may have a shape other than frustum-like, in order to give the edge of the glass sheet, by grinding, a shape that is profiled at will. In this case one speaks more appropriately of milling.

The constructive details can be replaced with other technically equivalent ones.

The materials and dimensions may be any according to the requirements, in particular arising from the dimensions (base and height) of the glass sheets 1.

The disclosures in Italian Patent Application No. 102016000103219 (UA2016A007329) from which this application claims priority are incorporated herein by reference.

The invention claimed is:

1. An automatic machine for grinding the edges of a perimeter of rectangular or non-rectangular contoured glass sheets that are substantially planar and arranged vertically or slightly inclined with respect to the vertical, comprising a machine body provided with a bottom configured to contact a floor surface, a pseudovertical resting and sliding surface, preceded by a corresponding upstream pseudovertical resting and sliding surface and followed by a corresponding downstream pseudovertical resting and sliding surface and with corresponding motorized support and conveyance rollers or belts, arranged below respective pseudovertical resting and sliding surfaces and actuating a synchronous axis for the conveyance of the lower portion of said glass sheet and of at least one pair of working heads, which can move with respect to said glass sheet along the perimeter of said glass sheet with a synchronous feeding motion and provided with a synchronous rotary motion, each one of said pair of working heads being movable on corresponding vertical carriages provided with a synchronous vertical translational motion along vertical axes and comprising a fixed body and a rotating body, each fixed and rotating body ending with a working head which comprises a tool of the type with a rigid grinding wheel which has a circular shape in rotation with a cutting motion in order to perform said grinding, adjustable with an adjustment motion along respective axes, which are perpendicular to the plane of said glass sheet, wherein through said machine body and said motorized support and conveyance rollers or belts and an input conveyor and said motorized support and conveyance rollers or belts and an output conveyor and said motorized support and conveyance rollers or belts, or part thereof, at least two conveyance means configured for conveying said glass sheets, a lower conveyance means configured to provide synchronous movement along a lower axis and an upper conveyance means configured to provide synchronous movement along an upper axis, the lower axis being closer to the bottom of the machine than the upper axis, which actuate respectively the synchronous motions about respective axes, engage and convey said glass sheets, said glass sheets being interfaced alternately, odd sheets of said glass sheets with said lower conveyance means and even sheets of said glass sheets with said upper conveyance means.

2. The machine according to claim 1, wherein each one of said conveyance means is constituted by a sucker carriage.

3. The machine according to claim 1, wherein each one of said conveyance means is constituted at least by two sucker carriages.

4. The machine according to claim 3, wherein said at least two sucker carriages are adjustable in mutual displacement in order to couple with said glass sheets according to the length of said glass sheets.

5. The machine according to claim 1, wherein said working heads, which can move with respect to said glass sheet along the perimeter of said glass sheet, in addition to said working heads with corresponding tools, contain jaws for retaining the portion of said glass sheet which act transversely to said glass sheet at their perimetric margin in order to prevent the vibration thereof during the active machining step of said tools, said retention jaws arranging themselves tangentially with respect to the perimeter of said glass sheet by the action of synchronous rotation axes.

6. The machine according to claim 5, wherein by means of the combination of the synchronous motions of said motorized support and conveyance rollers or belts with respect to said synchronous axis, of the motion of at least one between said at least one pair of working heads with respect to said rotation axes and of at least one of said vertical carriages along said vertical axes and of at least one of four sucker carriages with respect to said lower axis or said upper axis, the grinding work follows contours of said glass sheet of the type other than rectangular.

7. The automatic machine according to claim 1, wherein said tool is a diamond grinding wheel.

8. The automatic machine according to claim 7, wherein said diamond grinding wheel is of a type that is contoured as a function of the shape to be obtained of the edge of the glass sheet in the direction of the thickness.

9. The automatic machine according to claim 7, wherein said diamond grinding wheel performs machinings that range from rounding of the edges to profile shaping that affects the entire thickness of said glass sheet and range from grinding to milling to polishing.

* * * * *